United States Patent [19]

Yamamoto et al.

[11] 4,004,927

[45] Jan. 25, 1977

[54] PHOTOGRAPHIC LIGHT-SENSITIVE MATERIAL CONTAINING LIQUID ORGANOPOLYSILOXANE

[75] Inventors: Nobuo Yamamoto; Kiyotaka Hori; Masakazu Yoneyama; Yasuhiro Nakayama, all of Minami-ashigara; Akira Abe, Annaka, all of Japan

[73] Assignee: Fuji Photo Film Co., Ltd., Minami-ashigara, Japan

[22] Filed: Feb. 3, 1975

[21] Appl. No.: 546,487

[30] Foreign Application Priority Data

Feb. 1, 1974 Japan ..... 49-13466

[52] U.S. Cl. ..... 96/67; 96/84 R; 96/85; 96/87 R; 96/114; 427/96

[51] Int. Cl.[2] ..... G03C 1/76; G03C 1/72

[58] Field of Search ..... 96/114, 67, 84, 85, 96/87, 35.1; 427/96

[56] References Cited

UNITED STATES PATENTS

| | | | |
|---|---|---|---|
| 3,042,522 | 7/1962 | Ben-Ezre | 96/87 |
| 3,294,537 | 12/1966 | Milton | 96/114 |
| 3,489,567 | 1/1970 | McGraw | 96/114 X |
| 3,549,368 | 12/1970 | Collins et al. | 96/35.1 |
| 3,782,940 | 1/1974 | Michiniro et al. | 96/35.1 |
| 3,859,090 | 1/1975 | Yoerger et al. | 96/1.5 |
| 3,911,169 | 10/1975 | Lesaicherre et al. | 96/35.1 |

*Primary Examiner*—Edward C. Kimlin
*Attorney, Agent, or Firm*—Sughrue, Rothwell, Mion, Zinn & Macpeak

[57] ABSTRACT

A photographic light-sensitive material comprising a support having thereon at least one light-sensitive silver halide emulsion layer and with at least one photographic layer of the photographic light-sensitive material containing a liquid organopolysiloxane having therein at least one siloxane unit, in which (1) a methyl group and (2) an alkyl group, a cycloalkyl group, an alkoxyalkyl group, an aralkyl group, an aryloxyalkyl group or a 2,3-epoxypropyloxyalkyl group with each group having at least 5 carbon atoms are attached to the silicon atom of the siloxane unit.

14 Claims, No Drawings

PHOTOGRAPHIC LIGHT-SENSITIVE MATERIAL CONTAINING LIQUID ORGANOPOLYSILOXANE

BACKGROUND OF THE INVENTION

1. Field of the Invention

The present invention relates to photographic light-sensitive materials having improved physical properties and more particularly to photographic light-sensitive materials comprising a support having thereon a photographic layer whose physical properties are improved by the presence of an organopolysiloxane containing a siloxane unit having a methyl group and an alkyl group containing at least 5 carbon atoms attached to the silicon atom of the siloxane unit.

2. Description of the Prior Art

Photographic light-sensitive materials generally comprise a support, such as glass, paper, synthetic resin film or synthetic resin-coated paper, and a combination of various photographic layers coated on the support, such as light-sensitive emulsion layers, interlayers, a protective layer, a backing layer, an antihalation layer, an anti-static layer, and the like. With photographic materials, often undesirable effects resulting from the frictional contact between the photographic material and various parts of pieces of equipment, devices or cameras, between the photographic material and an adherent such as dust or flock, or between two photographic materials in their handling, such as winding, unwinding or driving, during shooting, processing, printing and projection as well as during the production steps, such as coating, drying and cutting, etc., occur. For example, abrasions and scratches may be formed on the surface or back surface of a photographic material; the travelling ability of the photographic material in equipment such as a camera and the like may be deteriorated; and film scraps may be produced in equipment such as a camera and the like.

A variety of methods have been proposed for obtaining photographic light-sensitive materials having improved physical properties by increasing the abrasion resistance of the photographic layers in the photographic light-sensitive materials, or by reducing the sliding friction of the photographic light-sensitive materials so that they can move freely through film magazines, camera gates, particularly motion picture camera gates, motion picture projector gates, printer gates, and the like, without damaging the photographic layer. As examples of such methods, mention can be made of following: a method for increasing the resistance to abrasion by adding a certain class of hardners to gelatin as described in British Patent No. 1,270,578; a method for imparting slippage properties to photographic films by incorporating a combination of dimethylsilicone and a particular surface active agent into the photographic emulsion layers or protective layers as described in U.S. Pat. No. 3,042,522; a method for imparting slippage properties by coating a mixture of dimethylsilicone and diphenylsilicone on the back surface of a photographic film support as described in U.S. Pat. No. 3,080,317; a method for imparting slippage properties to photographic films by incorporating a methylphenylsilicone having triphenyl terminal groups in the protective layers as described in British Pat. No. 1,143,118; and a method for providing photographic light-sensitive materials having improved slippage properties and anti-tackiness by incorporating a dialkylsilicone and a surfactant of a $\beta$-alanine type into a hydrophilic colloid layer such as a photographic emulsion layer and the like.

However, when applied to photographic light-sensitive materials in order to improve their physical properties, at least one disadvantage occurs with each of these methods even though some improvement in slippage properties and the like is achieved. That is, the stickiness of the film surfaces may not be eliminated completely; coating properties may be adversely affected during preparation of the photographic materials or the films may become extremely repellant since large amounts of silicone must be used in order to impart good slippage properties to them, since the silicones used only have a slight effect in improving slippage properties; or in order to obtain photographic materials having practical physical properties by using diloweralkyl- or diphenylsilicones, a mixture of surface active agents having a certain limited structure may have to used. In addition, while these known lubricating compositions provide some improvement, they do not sufficiently enhance the abrasion resistance of the photographic films and may be accompanied by the formation of a haze that impairs the transparency of the films after photographic processing.

SUMMARY OF THE INVENTION

An object of the present invention is to provide photographic light-sensitive materials with excellent physical properties having lubricated surfaces and, at the same time, increased abrasion resistance.

Another object of the present invention to provide photographic light-sensitive materials containing a photographic layer having improved slippage properties while retaining good transparency.

Still another object of the present invention is to provide a method for applying a specific type of organopolysiloxane which has never employed in a photographic light-sensitive material to a photographic layer coated on a support, without impairing the coating properties.

These and other objects of the present invention will become apparent from the following description.

These and other objects of the present invention are accomplished by a photographic light-sensitive material comprising a support having thereon at least one light-sensitive silver halide emulsion layer and the photographic light-sensitive material having at least one photographic layer containing a liquid organopolysiloxane having therein at least one siloxane unit, in which (1) a methyl group and (2) an alkyl group, a cycloalkyl group, an alkoxyalkyl group, an aralkyl group, an aryloxyalkyl group or a 2,3-epoxypropyloxyalkyl group with each group having at least 5 carbon atoms are attached to the silicon atom of the siloxane unit.

DETAILED DESCRIPTION OF THE INVENTION

The present invention is based on the discovery that the photographic properties of a photographic light-sensitive material are improved by employing the above-described organopolysiloxane with a photographic light-sensitive material.

The photographic light-sensitive materials according to this invention as described above comprise a support having a liquid organopolysiloxane having therein at least one siloxane unit, in which (1) a methyl group and (2) an alkyl group, a cycloalkyl group, an alkoxyalkyl group, an aralkyl group, an aryloxyalkyl group or a 2,3-epoxypropyloxyalkyl group with each group having at least 5 carbon atoms are attached to the silicon atom of the siloxane unit in one or more of the photographic layers on the support.

Suitable liquid organopolysiloxanes used in this invention are those that on the average have for a silicon atom, from 1.85 to 2.50 organic groups consisting of 50 to 95 mol% of methyl groups and 5 to 50 mol% of organic groups selected from the group consisting of alkyl groups, cycloalkyl groups, alkoxyalkyl groups, aralkyl groups, aryloxyalkyl groups and 2,3-epoxypropyloxyalkyl groups, each of these groups having at least 5 carbon atoms, preferably 5 to 20 carbon atoms.

Useful liquid organopolysiloxanes according to the invention include cyclic siloxanes having siloxane units represented by the following general formula (I):

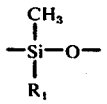

(I)

wherein $R_1$ represents an alkyl group, a cycloalkyl group, an alkoxyalkyl group, an aralkyl group, an aryloxyalkyl group or a 2,3-epoxypropyloxyalkyl group having from 5 to 20 total carbon atoms; and straight-chain siloxanes containing siloxane units represented by the above general formula (I) and terminal groups represented by the following general formula (II):

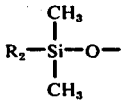

(II)

wherein $R_2$ represents an alkyl group having from 1 to 20 carbon atoms, and a cycloalkyl group, an alkoxyalkyl group, an aralkyl group, an aryloxyalkyl group and a 2,3-epoxypropyloxyalkyl group having 5 to 20 carbonatoms.

Useful liquid organopolysiloxanes according to the invention also include those comprising siloxane units represented by the following general formula (III):

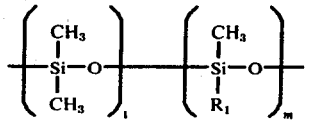

(III)

wherein $R_1$ has the same meanings as defined in above general formula (I), l represents 0 or a positive integer, m represents a positive integer, and l+m represents a positive integer of from 1 to 1000, preferably from 2 to 500, with the organopolysiloxanes containing siloxane units of the general formula (III) having the terminal groups as defined for the general formula (II).

Additional useful liquid organopolysiloxanes include also those comprising siloxane units represented by the general formula (IV):

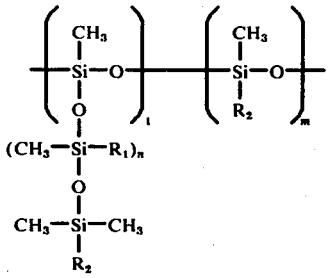

(IV)

wherein $R_1$ and $R_2$ are as defined in the formulae (I) and (II), n is an integer of 1 or more, l is 0 or a positive integer, m is a positive integer and l+m respresents a positive integer of from 1 to 1000, preferably 2 to 500.

Specific examples of $R_1$ for the liquid organopolysiloxanes include pentyl, methylpentyl, cyclopentyl, cyclohexyl, dimethylpentyl, heptyl, methylhexyl, octyl, eicosyl, phenylethyl, methylphenylethyl, phenylpropyl, cyclohexylpropyl, dibenzyloxypropyl, phenoxypropyl, tolyloxypropyl, naphthylpropyl, ethoxypropyl, butoxypropyl, octadecyloxypropyl, 2,3-epoxypropyloxypropyl and 2,3-epoxypropyloxybutyl groups.

Specific examples of $R_2$ for the liquid organopolysiloxanes include methyl, ethyl, propyl, n-butyl, sec-butyl, tert-butyl as well as the specific examples defined above for $R_1$.

Examples of representative liquid organopolysiloxanes used in the invention include the following organopolysiloxanes (1)

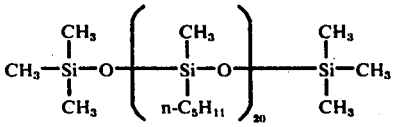

(2)

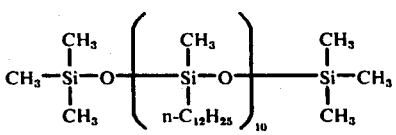

(3)

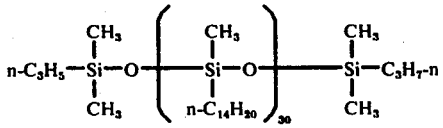

-continued
(4)
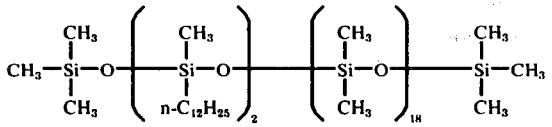
(5)
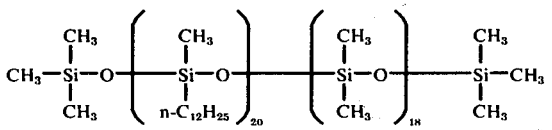
(6)
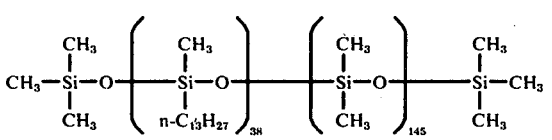
(7)
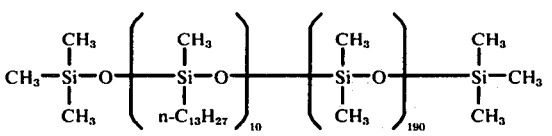
(8)
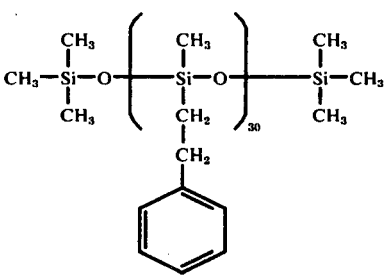
(9)
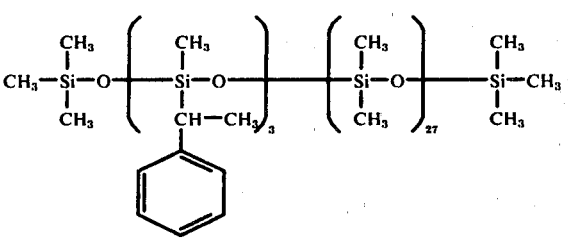
(10)
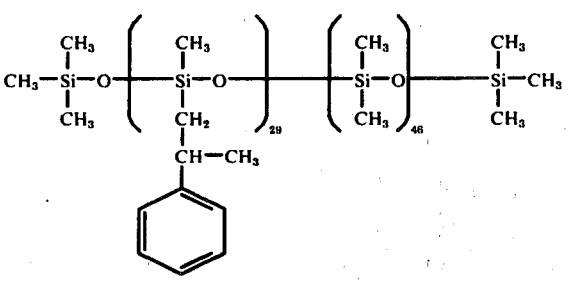
(11)
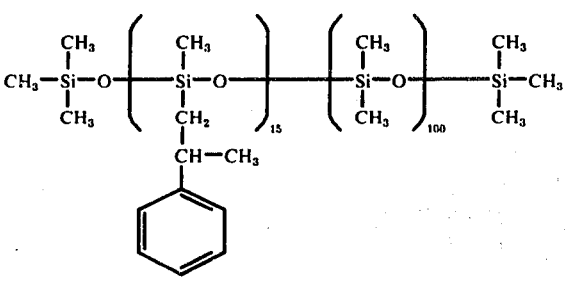

-continued
(12)
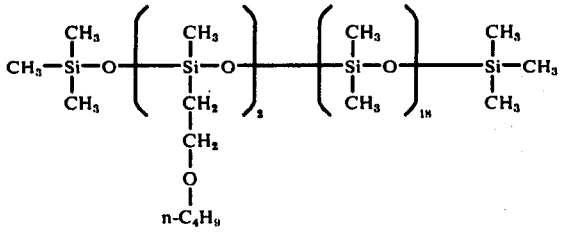
(13)
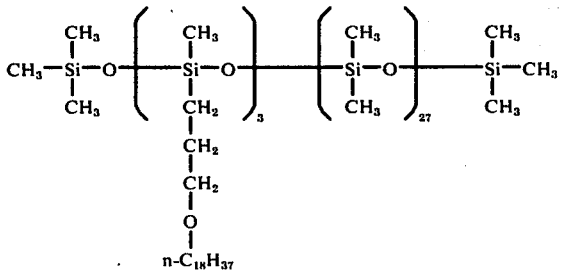
(14)
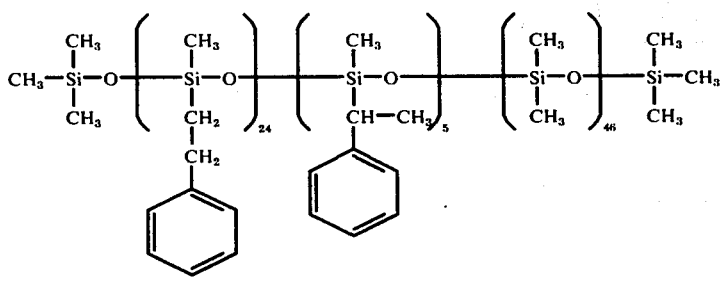
(15)
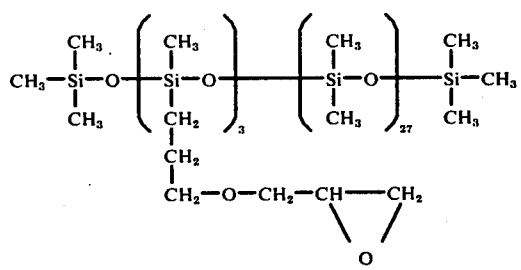
(16)
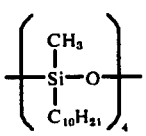
(17)
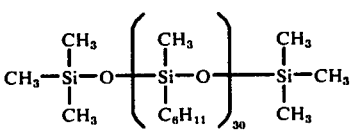
(18)
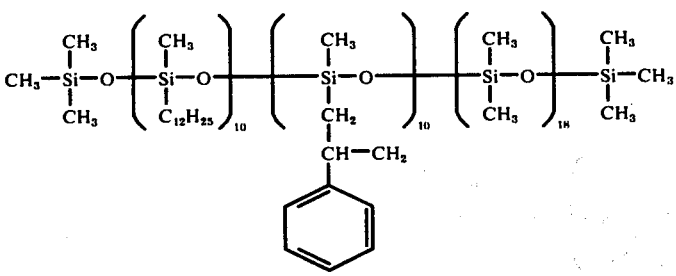
(19)
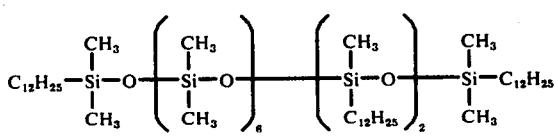

-continued (20)

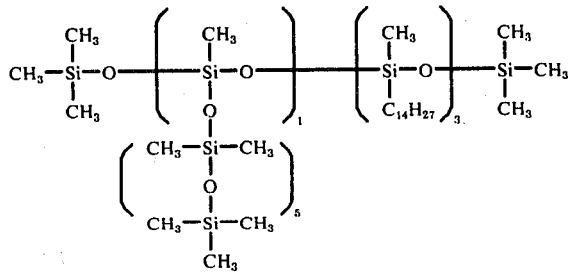

The preparation of the liquid organopolysiloxanes used in the invention is known and described, for example, in F. G. A. Stone and W. A. G. Graham, Inorganic Polymers, 230–231 and 288–295, Academic Press (1962); W. Noll, Chemistry and Technology of Silicones, 209–211, Academic Press, (1968); P. F. Bruins et al., Silicone Technology, 64–66, John Wiley and Sons, (1970); and J. P. Kennedy et al., High Polymer, Vol. 23, Part II, 773–775. They can also be prepared readily by the reaction of each organochlorosilane component with water as described, for example, in Japanese Patent Publication No. 22361/61; by the addition reaction of olefins to siloxanes containing SiH groups using a metallic catalyst as described, for example, in Japanese Patent Publication Nos. 10771/60; 28694/68 and 14898/70; and the like.

Among the organopolysiloxanes which can be used in the invention, as to the organopolysiloxanes represented by the above general formula (II) which are comprise the siloxane units represented by the above general formula (I) and dimethylsiloxane units, those having from about 0 to about 95 mol%, preferably from 10 to 80 mol%, of dimethylsiloxane units and from about 5 to about 100 mol%, preferably from 20 to 90 mol%, of siloxane units represented by the general formula (I) are effective, depending upon the classes of the organic groups contained therein.

The refractive index of the organopolysiloxanes used in the invention is not particularly limited but those having a refractive index at 25° C of about 1.405 to 1.650, preferably 1.415 to 1.550, are effective. When an organopolysiloxane having a refractive index smaller than about 1.405 or larger than about 1.650 is employed, the transparency of the photographic light-sensitive materials may be adversely effected, particularly after the light-sensitive materials have been processed and dried.

The liquid organopolysiloxanes which can be used in this invention are those which are liquids at 20° C. The viscosity of the organopolysiloxanes used in the invention is not particularly limited, and any of the above-described liquid organopolysiloxanes, which can be prepared by general methods, provide desirable effects but those having a viscosity at 25° C using a modified Ostwald viscometer of about 20 to 100,000 entistokes, preferably 100 to 10,000 Centistokes, are usually suitable.

In practicing the present invention, the above-described organopolysiloxanes can be added to a coating solution for forming a light-sensitive emulsion layer or non-light-sensitive photographic layer, such as a protective layer or a backing layer, before coating on a support. The organopolysiloxanes used in the invention can also be overcoated on or impregnated in the light-sensitive material after each of the photographic layers is provided on the support. That is, the organopolysiloxanes can be added to a photographic emulsion, a non-light-sensitive hydrophilic colloid, and the like as a water-dispersion prepared previously in the presence of an appropriate dispersant, preferably a nonionic surface active agent such as a long-chain alcohol or polyalkylene oxide adducts of a long-chain fatty acid; or can be added and mixed with each photographic layer in which they are to be employed by incorporation directly or diluted with an organic solvent capable of dissolving the organopolysiloxane such as acetone, ethyl acetate, amyl acetate, a halogenated hydrocarbon etc., into a variety of binder-containing coating solutions in the presence or absence of an appropriate dispersant, preferably a nonionic, anionic or amphoteric dispersant or a mixture thereof, before coating. The organopolysiloxanes used in the invention can also be coated, directly or dissolved in a solvent described above, using a dip method as described, for example, in U.S. Pat. No. 3,335,026; using an extrusion method such as is described, for example, in U.S. Pat. No. 2,761,791; using a spray method such as is described, for example, in U.S. Pat. No. 2,674,167; and the like. In order to achieve the remarkable effects resulting from the organopolysiloxanes used in this invention, they can be applied preferably to a outermost photographic layer such as a protective layer, an anti-static layer, an anti-halation layer, an abrasion-preventing layer, and the like.

The amount of the organopolysiloxanes used in this invention is not particularly limited. However, when applied to a coating solution before coating on a support as a photographic layer, the organopolysiloxanes are preferably utilized in a concentration of from about 0.02 to 10% by weight, particularly from 0.1 to 6.0% by weight, based on the weight of the solid contents of the coating solution. If the amount is smaller than about 0.02% by weight, it is difficult to obtain the desired effects and if the amount is larger than about 10% by weight, it becomes uneconomical. Further when the organopolysiloxane is applied to a photographic material layer by impregnation, a suitable amount used in the impregnating solution is that amount which is effective when impregnated by a dip coating method, etc., results in the layer containing about 1 mg to 100 mg of the organopolysiloxane /m² of the support, preferably 5 to 70 mg of the organopolysiloxane /m² of the support.

When the organopolysiloxanes in accordance with the invention are applied to a photographic layer in the form of a preformed water-dispersion, a nonionic surfactant, such as a polyalkylene oxides, a glycerol, a sorbitan, and the like, which are described, for example, in U.S. Pat. Nos. 2,240,472; 3,158,484; 3,294,540 and 3,442,654; and British Patent Nos. 1,077,317 and 1,198,450; as well as in references such as N. Sinfert, *Surface Active Ethylene Oxide Adducts*, Pergamon Press Ltd., 1969, and the like, can be utilized as the required emulsifier or dispersant. Representative examples of such surfactants include polyoxyethylene alkylphenyl ethers such as

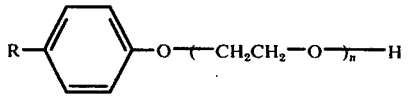

(wherein R=$C_8H_{17}$ or $C_9H_{19}$; $n$= 20 to 50) and the like; polyoxyethylene alkyl ethers such as R'-O(CH$_2$CH$_2$-O)$_{n'}$—H (wherein R'=$C_8H_{17}$, $C_{12}H_{25}$, $C_{13}H_{27}$, $C_{16}H_{33}$ or $C_{18}H_{37}$; $n'$=4 to 60) and the like; polyoxyethylene alkyl esters such as R''-COO(CH$_2$CH$_2$-O)$_{n''}$ H (wherein R''=$C_{11}H_{23}$, $C_{17}H_{33}$ or $C_{17}H_{35}$; $n'$=40 to 60) and the like; sorbitan fatty acid esters such as sorbitan laurate, sorbitan palmitate, sorbitan stearate, sorbitan oleate, and the like; polyoxyethylenesorbitan fatty acid esters such as polyoxyethylenesorbitan laurate, polyoxyethylenesorbitan palmitate, polyoxyethylenesorbitan stearate, polyoxyethylenesorbitan oleate, and the like; and polyoxyalkylene block polymers such as polyoxyethylene-polyoxypropylene block copolymers, polyoxyethylene-polyoxypropylene dodecyl ethers, etc.

Examples of useful surfactants which are used where the organopolysiloxanes in accordance with the invention are added to a hydrophilic colloid-containing solution before coating as a photographic layer described above include nonionic surfactants such as polyalkylene oxides, glycerols, sorbitans, and the like; anionic surfactants which contain an acid group such as, for example, a carboxyl, sulfonic, phosphoric, sulfoester or phosphoester group; and amphoteric surfactants such as aminosulfonic acids, aminocarboxylic acids, sulfo- or phosphoesters of aminoalcohols, and the like.

Some examples of these useful surfactants are described, for example, in U.S. Pat. Nos. 2,240,472; 2,739,891; 3,068,101; 3,158,484; 3,294,540; 3,415,649; 3,442,654; 3,506,449; 3,589,906 and 3,666,474; German Patent Application (OLS) No. 1,961,638; and British Patent Nos. 1,077,371; 1,179,290 and 1,198,450; as well as in references such as A.W. Perry, *Surface Active Agents*, Interscience Publication Inc., (1958); J.P. Sisley, *Encyclopedia of Surface Active Agents*, Vol. II, Chemical Publishing Co., (1965); and the like. These surfactants are usually employed, alone or in combination, as a dispersing and/or coating aid in a solution for forming a photographic emulsion layer or another photographic layer described above but, in some cases, they can be employed for other purposes such as, for example, emulsification or dispersing of a photographic additive other than the organopoly-siloxanes in accordance with the invention, sensitization, improvement of photographic properties, anti-static purposes, prevention of adhesion, and the like.

These dispersants are commonly employed in an amount of about 0.5 to about 200% by weight, preferably 1 to 100% by weight, based on the amount of the organopolysiloxane.

As has already been described, in improving the physical properties of a photographic light-sensitive material by employing a substantially water-insoluble organopolysiloxane in accordance with the invention, the organopolysiloxane is preferably dispersed into a variety of coating solutions before coating as a photographic layer by various methods. In such cases, the organopolysiloxanes dispersed in these coating solutions have ordinarily a particle size of about 0.1 to about 10 $\mu$, preferably about 0.2 to about 7 $\mu$. If the particle size is smaller than about 0.1 $\mu$, satisfactory slippage properties are scarcely obtained and if the particle size is larger than about 10 $\mu$, the lubricating effects become so high that the coating properties and transparency of the coated film may be impaired.

In the photographic light-sensitive materials of the invention any of the supports which are commonly used as a support for photographic light-sensitive materials can be utilized. Examples of suitable supports include cellulose nitrate films, cellulose acetate films, cellulose acetate butyrate films, cellulose acetate propionate films, polystyrene films, polyethylene terephthalate films, polycarbonate films, laminated products thereof, paper, and the like. Other supports such as papers which are coated or laminated with baryta or a $\alpha$-olefin polymer, particularly those prepared from a monomer having from 2 to 10 carbon atoms, such as polyethylene, polypropylene, and the like; and synthetic resin films in which the adhesive properties with respect to other synthetic resin films and the printing properties are improved by roughening the surfaces thereof, such as those described in Japanese Patent Publication No. 19068/72, can also be used preferably.

In the photographic light-sensitive materials of the invention, various hydrophilic colloids can be employed as a binding agent for the photographic emulsion layers and/or other photographic layers. Examples of such binding agents include gelatin; colloidal albumin; casein; cellulose derivatives such as carboxymethylcellulose, hydroxyethylcellulose, and the like; saccharide derivatives such as agar-agar, sodium alginate, starch derivatives, and the like; synthetic hydrophilic polymers such as polyvinylalcohol, poly-N-vinylpyrrolidone, polyacrylate copolymers, polyacrylamides, derivatives or partial hydrolysis products thereof; and the like. Compatible mixtures of these colloids can also be used, if desired.

Of these binding agents, gelatin is most commonly employed. The gelatin can be replaced, partially or completely, by a synthetic polymer; a so-called gelatin derivative which is prepared by treating or modifying gelatin with a compound having a group capable of reacting with a functional group contained in gelatin molecule, such as an amino, imino, hydroxyl, or carboxyl group; or a grafted polymer which is obtained by grafting other polymer chains onto the gelatin molecule.

Examples of such compounds which can be used for the preparation of the above-described gelatin derivatives include isocyanates such as those described, for example, in U.S. Pat. No. 2,614,928; acid chlorides; acid anhydrides; acid anhydrides such as those described in U.S. Pat. No. 3,118,766; bromoacetic acids such as those described in Japanese Patent Publication No. 5514/64; phenyl glycidyl ethers such as those described in Japanese Patent Publication No. 26845/67; vinylsulfone compounds such as those described in U.S. Pat. No. 3,132,945; N-allylvinylsulfonamides such as those described in British Patent No. 861,414; maleinamide compounds such as those described in U.S. Pat. No. 3,186,846; acrylonitriles such as those described in U.S. Patent No. 2,594,293; polyalkylene oxides such as those described in U.S. Pat. No. 3,312,553; epoxy compounds such as those described in Japanese Patent Publication No. 26845/67; esters of acids such as described in U.S. Pat. No. 2,763,639; and alkane sultones such as those described in British Patent No. 1,033,189. As the graft polymers which can be grafted to gelatin, a wide variety of polymers or copolymers of the so-called vinyl monomers, such as acrylic acid, methacrylic acid, the ester, amide, or nitrile derivatives thereof, etc., or styrene as described in U.S. Pat. Nos. 2,763,625; 2,831,767 and 12,956,884; *Polymer Letters*5, 595 (1967); *Photo. Sci. Eng.*, 9, 148 (1965); *J. Polymer Sci.*, A-1, 9, 3199 (1971); and the like can be employed. Hydrophilic vinyl-polymers having a certain degree of compatibility with gelatin, such as polymers or copolymers of acrylic acid, acrylamide, methacrylamide, hydroxyalkylacrylate, hydroxyalkylmethacrylate, and the like are particularly preferred.

The photographic emulsion layers and other layers which are used in this invention can contain synthetic polymer latexes alone or in combination, for example, water-dispersed vinyl polymer latexes, particularly those capable of improving the dimensional stability of photographic materials. These latexes can also be used in combination with a water-permeable hydrophilic colloid. Examples of such water-permeable hydrophilic colloid polymers are described, for example, in U.S. Pat. Nos. 2,376,005; 2,739,137; 2,853,457; 3,062,674; 3,411,911; 3,488,708; 3,525,620; 3,635,715; 3,607,290 and 3,645,740; British Patent Nos. 1,186,699 and 1,307,373; and the like. Of these polymers, copolymers and homo-polymers prepared from monomers selected from alkylacrylates, alkylmethacrylates, acrylic acid, methacrylic acid, sulfoalkylacrylates, sulfoalkylmethacrylates, glycidyl acrylate, glycidyl methacrylate, hydroxyalkylacrylates, hydroxyalkylmethacrylates, alkoxyalkylacrylates, alkoxymethacrylates, styrene, butadiene, vinyl chloride, vinylidene chloride, maleic anhydride, and itaconic anhydride are commonly employed. The so-called graft type emulsion polymerization latexes which are prepared by the emulsion polymerization of the above-described vinyl compounds in the presence of a protective hydrophilic colloid can also be used.

The photographic emulsion layers and/or other photographic layers can be hardened using conventional techniques. Examples of suitable hardeners include, for example, aldehyde compounds such as formaldehyde and glutaraldehyde; ketone compounds such as diacetyl and cyclopentadione; reactive halogen-containing compounds such as bis(2-chloroethylurea), 2-hydroxy-4,6-dichloro-1,3,5-triazine, and those described, for example, in U.S. Pat. Nos. 3,288,775 and 2,732,303; and British Patent Nos. 974,723 and 1,167,207; reactive olefin-containing compounds such as divinyl sulfone, 5-acetyl-1,3-diacryloylhexahydro-1,3,5-triazine, and those described, for example, in U.S. Pat. Nos. 3,635,718; 3,232,763; 3,490,911 and 3,642,486; and British Patent No. 994,869; N-methylol compounds such as N-hydroxymethylphthalimide, and those described, for example, in U.S. Pat. Nos. 2,732,316 and 2,586,168; isocyanates such as those described in U.S. Pat. No. 3,103,437; aziridine compounds such as those described in U.S. Pat. Nos. 3,017,280 and 2,983,611; acid derivatives such as those described, for example, in U.S. Pat. Nos. 2,725,294 and 2,724,295; carbodiimide compounds such as those described in U.S. Pat. No. 3,100,070 and the like; epoxy compounds such as those described in U.S. Pat. No. 3,091,537 and the like; isooxazole compounds such as those described, for example, in U.S. Pat. Nos. 3,321,313 and 3,543,292; halocarboxyaldehydes such as mucochloric acid; dioxane derivatives such as dihydroxydioxane, dichlorodioxane, and the like; and inorganic compounds such as chrome alum, zirconium sulfate, and the like. Instead of using the above-described hardener compounds, hardener precursors such as alkali metal bisulfite-aldehyde adducts, methylol derivatives of hydantoin, primary fatty acid nitroalcohols, etc., can also be used.

The silver-halide photographic emulsions used in the invention can be prepared using conventional techniques, such as by mixing a solution of a water-soluble silver salt (e.g., silver nitrate) with a solution of a water-soluble halide (e.g., potassium bromide) in the presence of a water-soluble polymer such as gelatin. In addition to silver chloride and silver bromide, mixed silver halides, such as silver chlorobromide, silver iodobromide and silver chloroiodobromide, can also be used as the silver halide. These silver halide grains can be prepared according to any of the known and conventional methods, including the so-called single jet, twin jet and controlled twin jet method. Mixtures of two or more silver halide photographic emulsions which are prepared separately can also be employed.

In order to prevent a reduction of sensitivity or the formation of fog during preparation, storage or processing, various components can be added to the photographic emulsions described above. A wide variety of known compounds such as heterocyclic compounds, mercury-containing compounds, mercapto compounds, metallic salts, and the like, including 4-hydroxy-6-methyl-1,3,3a,7-tetrazaindene, 3-methylbenzothiazole and 1-phenyl-5-mercaptotetrazole can be employed. Examples of useful compounds are described in U.S. Pat. Nos. 1,758,576; 2,110,178; 2,131,038; 2,173,628; 2,697,040; 2,304,962; 2,324,123; 2,394,198; 2,444,605; 2,444,606; 2,444,607; 2,444,608; 2,566,245; 2,694,716; 2,697,099; 2,708,162; 2,728,663; 2,728,664; 2,728,665; 2,476,536; 2,824,001; 2,843,491; 2,886,437; 3,052,544; 3,137,577; 3,220,839; 3,226,231; 3,236,652; 3,251,691; 3,252,799; 3,287,135; 3,326,681, 3,420,668; 3,619,198; 3,622,339 and 3,650,759; British Patent Nos. 893,428; 403,789; 1,173,609 and 1,200,188; and the like.

The silver halide emulsions can be chemically sensitized according to conventional methods. Examples of chemical sensitizers include gold compounds such as chloroaurates and gold trichloride, as described in U.S. Pat. Nos. 2,399,083; 2,540,085; 2,597,856 and 2,597,915; salts of noble metals such as platinum, palladium, iridium, rhodium and ruthenium, as described in U.S. Pat. Nos. 2,448,060; 2,540,086; 2,566,245; 2,566,263 and 2,598,079; sulfur compounds capable of forming silver sulfide by reaction with silver salts, as described in U.S. Pat. Nos. 1,574,944; 2,410,689; 3,189,458; 3,501,313; and the like; reducing substances such as stannous salts, amines and the like, as described in U.S. Pat. Nos. 2,487,850; 2,518,698; 2,521,925; 2,521,926; 2,694,637; 2,983,610; 2,983,601 and 3,201,254.

The photographic emulsions can be spectrally sensitized or super-sensitized using cyanine dyes such as cyanine, merocyanine and carbocyanine, individually or in combination, or in combination with other dyes such as styryl dyes and the like. Spectral sensitization techniques are well known and described, for example, in U.S. Pat. Nos. 2,493,748; 2,519,001; 2,977,229, 3,480,434; 3.672,897; 3,703,377; 2,688,545; 2,912,329; 3,397,060; 3,615,635 and 3,628,964; British Patent Nos. 1,195,302; 1,242,588 and 1,293,862; German Patent Application (OLS) Nos. 2,030,326 and 2,121,780; Japanese Patent Publication Nos. 4936/68; 14030/69 and 10773/68; U.S. Pat. Nos. 3,511,664; 3,522,052; 3,527,641; 3,615,613; 3,615,632; 3,617,295; 3,635,721 and 3,694,217; and British Pat. Nos. 1,137,580 and 1,216,203. These dyes can be appropriately chosen accordiing to the purposes and uses of the photographic light-sensitive materials to be sensitized.

The photographic light-sensitive materials of this invention can contain as a plasticizer polyols of the type described, for example, in U.S. Pat. Nos. 2,960,404; 3,042,524; 3,520,694; 3,656,956 and 3,640,721, in a photographic layer.

The photographic light-sensitive materials of the invention can be provided, in addition to one or more silver halide emulsion layers, with conventional non-light-sensitive photographic layers, for example, protective layers, filters layers, interlayers, anti-halation layers, subbing layers, backing layers, anti-static layers, and anti-curling layers.

The photographic light-sensitive materials of the invention can contain stilbenes, triazines, oxazoles, coumarins, and the like as a brightener; benzotriazoles, triazines, thiazolines, cinnamic acid esters, and the like as a UV absorber; a variety of known photographic filter dyes as a light absorber; waterinsoluble substances such as those described, for example, in British Patent Nos. 1,320,564 and 1,320,565; U.S. Pat. 3,121,060 as a lubricating agent or adhesion-preventing agent; or surface active agents such as those described in U.S. Pat. No. 3,617,286 in addition to the organopolysiloxanes for use in the invention, as desired, in a non-light-sensitive photographic layer. The photographic light-sensitive materials of the invention can also contain inorganic compounds having appropriate particle sizes, such as silver halide, silica, strontium barium sulfate, polymer latexes such as polymethylmethacrylate, and the like as a matting agent.

The photographic light-sensitive materials of the invention can contain in a photographic layer, including a photographic emulsion layer, particularly in the anti-static layer provided as the outermost layer, hydrophilic polymers such as those described, for example, in U.S. Pat. Nos. 2,725,297; 2,972,535; 2,972,537; 2,972,538; 3,033,679; 3,072,484; 3,262,807; 3,525,621; 3,615,531; 3,630,743; 3,653,906; 3,655,384 and 3,655,386; and British Patent Nos. 1,222,154 and 1,235,075; hydrophobic polymers such as those described, for example, in U.S. Pat. Nos. 2,973,263 and 2,976,148; biguanide compounds such as those described, for example, in U.S. Patent Nos. 2,584,362 and 2,591,590; anionic compounds of the sulfonic acid type such as those described, for example, in U.S. Pat. Nos. 2,639,234; 2,649,372; 3,210,251 and 3,457,076; phosphoric acid esters and quaternary ammonium salts such as those described, for example, in U.S. Pat. Nos. 3,317,344 and 3,514,291; cationic compounds such as those described, for example, in U.S. Pat. Nos. 2,882,157; 2,982,651; 3,399,995; 3,549,369 and 3,564,043, nonionic compounds such as those described, for example, in U.S. Pat. No. 3,625,695; amphoteric compounds such as those described, for example, in U.S. Pat. No. 3,736,268; complex compounds such as those described, for example, in U.S. Pat. No. 2,647,836; and organic salts such as those described, for example, in U.S. Pat. Nos. 2,717,834 and 3,655,387 as an anti-static agent.

The organopolysiloxanes used in the invention can be employed in all types of black-and-white or color photographic light-sensitive materials. In brief, in addition to the organosiloxanes in accordance with the invention, the photographic light-sensitive materials of the invention can preferably contain as an additive any of the known compounds, particularly those indicated herein, in supports, silver halide emulsion layers, and non-light-sensitive photographic layers, which are the elements comprising photographic light-sensitive materials.

The silver halide emulsions for used in this invention include a variety of silver halide photographic emulsions, such a orthochromatic emulsions, panchromatic emulsions, non-visible light recording emulsions, for example, IR or X-ray emulsions, and emulsions intended for color photography such as those containing color-forming couplers, dye-developers, or bleachable dyes.

The color photographic emulsions can contain 2- or 4-equivalent color couplers. Examples of suitable couplers include open-chain ketomethylene yellow color-forming couplers such as the benzoylacetanilides or pivaloylacetanilides; magenta colorforming couplers such as the pyrazolones or imidazolones; and cyan color-forming couplers such as the phenols or naphthols. Other coupers such as, for example, yellow couplers represented by general formula (I) described in Japanese Patent Publication No. 18256/73; magenta couplers described in Japanese Patent Application No. 56670/69; cyan couplers described in Japanese Patent Application No. 76515/71; colored couplers such as those described in U.S. Pat. Nos. 2,428,054; 2,449,966; 2,455,170; 2,600,788; 2,983,608; 3,148,062; and the like; and the DIR couplers as described in U.S. Pat. No. 3,227,554.

The organopolysiloxanes used in this invention are capable of improving the physical properties, such as resistance to abrasion, slippage properties, etc., of photographic light-sensitive materials without photographically adverse effects such as the formation of fog, desensitization, and the like occurring. In particular, the improvement in mechanical properties such as resistance to abrasion (or friction) is remarkable in comparison with the use of known lubricants for photographic use, such as diloweralkylsilicones, e.g., dimethylsilicones. This is a particularly important advantage in the preparation of photographic light-sensitive materials intended for rapid processing which can be processed in an automatic photographic processer at a higher rate under high pH and temperature conditions, without damaging the photographic emulsion layers; or in the preparation of positive motion picture films having increased mechanical strength which are capable of resistance to repeated projection.

The organopolysiloxanes in accordance with the present invention are capable of imparting proper slippage properties to photographic light-sensitive materials and, in particular, improving the suitability of use of motion picture films in motion picture cameras or projectors. When the invention is applied to motion picture films, the films have such good slippage properties that they can be driven quite smoothly in motion picture cameras, and film noise can be reduced remarkably. When this invention is applied to motion picture films, film dust is not left in motion picture cameras which may be produced from the partly damaged emulsion layers due to the sharp stress or overstress from camera parts contacting the moving films. Because of the improved physical properties of the back surface, the formation of scratches in the motion picture films of the invention which are generated in films which do not contain the organopolysiloxanes in accordance with the invention is completely prevented.

The photographic materials of the invention have additional important advantages attributable to the organopolysiloxanes, concerning the production and quality thereof. As has already been described, in applying the organopolysiloxanes in accordance with the invention to photographic light-sensitive materials, they can be added to photographic emulsions or non-light-sensitive hydrophilic colloids in the form of a water-dispersion prepared previously by the use of dispersants, or can be added and dispersed directly in photographic emulsions or non-light-sensitive hydrophilic colloids. In such cases the stabilities of the dispersions containing the organopolysiloxanes is very important with respect to the aptitude for the production of photographic materials. The organopolysiloxanes used in this invention have excellent emulsifying or dispersing properties compared with known silicones, and a homogeneous dispersion initially prepared can be maintained for more than a month in the form of a water-dispersion and more than several weeks in the form of a dispersion in a hydrophilic colloid. This is a great advantage in the production of photographic materials. In addition, the organopolysiloxanes used in the present invention do not impair the coating properties of the photographic emulsions or non-light-sensitive hydrophilic colloids. Since dimethylsilicones, which have been employed hitherto, have poor stabilities in the form of emulsions or dispersions, various problems in practice have been encountered in the coating of photographic emulsions or other hydrophilic colloids containing lubricating compositions containing dimethylsilicones. For example, in order to obtain good aptitude for preparation, these dimethylsilicone lubricating comositions must be used in combination with a particular dispersing agent. On the other hand, the organopolysiloxanes used in this invention impart good coating properties to emulsions or dispersions so that they can be advantageously utilized without such a limitation.

Still another great advantage of the invention is that the light-sensitive materials containing the organopolysiloxanes according to the invention have excellent transparency. In general, silicones which are used for the purpose of imparting slippage properties to light-sensitive materials, are dispersed into hydrophilic colloids in the form of fine particles with aid of an emulsifier, and coated on a support. In such cases, silicone emulsions having smaller particle sizes tend to impart smaller lubricating effects, and those having larger particle sizes tend to impart greater slippage properties. However, increasing the particle size tends to reduce the transparency of the dried photographic layers after processing and to increase the haze level. Accordingly, particle sizes of the silicone emulsions must be controlled within a certain range. In other words, the lubricating effects are limited to a range in which the transparency of the photographic materials is not impaired.

It has been surprisingly found that the organopolysiloxanes used in this invention are capable of imparting lubricating effects over a wider range of particle sizes than for known dimethylpolysiloxanes, while maintaining the good transparency of the photographic layers. This is of great importance for controlling practical slippage properties according to the characteristics required for the photographic light-sensitive materials. It is of great advantage that the liquid organopolysiloxanes used in this invention are superior in lubricating effects are transparency to known dimethylsiloxanes when used in the same amount and at the same particle size. It is not clear why the organopolysiloxanes used in this invention exhibit properties superior to those of the dimethylsiloxanes, but this is presumably because the organopolysiloxanes used in the present invention have a refractive index which is closer to that of the vehicles in the dry state employed in photographic layers than that of known silicones.

The present invention is further illustrated in greater detail by the following examples. Unless otherwise indicated, all parts, percents, ratios and the like are by weight.

EXAMPLE 1

Onto a poly(ethylene terephthalate) film support were coated the following layers:

Layer 1:

Red-sensitive silver halide emulsion layer: A coupler-free, high-speed gelatino silver iodobromide emulsion layer rendered red-sensitive with a sensitizing dye and coated at a silver coverage of 15 mg/100 $cm^2$.

Layer 2:

Green-sensitive silver-halide emulsion layer: A coupler-free, high-speed gelatino silver iodobromide emulsion rendered green-sensitive with a sensitizing dye and coated at a silver coverage of 15 mg/100 $cm^2$.

Layer 3:

Yellow filter layer: A gelatin layer containing a yellow colloidal silver dispersion and coated at a silver coverage of 25 mg/100 $cm^2$.

Layer 4:

Blue-sensitive silver halide emulsion layer: A coupler-free, high-speed gelatino silver iodobromide emulsion layer coated at a silver coverage of 20 mg/100 $cm^2$.

Onto the resulting film were coated and dried as a fifth layer surface protecting layers (1.5 $\mu$ in dried thickness) having the compositions shown in Table 1 to provide eight kinds of multilayer color photographic light-sensitive materials.

Table 1

| Sample | Matting Agent[1)] | Hardener[1)] | Emulsifier[1),2)] | Lubricant[1),2)] |
|---|---|---|---|---|
| Ia | Silver Halide Grains 10 g + Polymethyl Methacrylate | Aqueous Mucochloric Acid Solution (1%) 200ml | Aqueous Sodium Dodecylbenzenesulfonate Solution (5%) | Liquid Paraffin 2 g (Control) |

Table 1-continued

| Sample | Matting Agent[1] | Hardener[1] | Emulsifier[1,2] | Lubricant[1,2] |
|---|---|---|---|---|
| | 4 g | | 40 ml | |
| Ib | " | " | " | Compound (1) 2 g |
| Ic | " | " | " | Compound (2) 2 g |
| Id | " | " | " | Compound (4) 2 g |
| Ie | " | " | " | Compound (5) 2 g |
| If | " | " | " | Compound (6) 2 g |
| Ig | " | " | " | Compound (10) 2 g |
| Ih | " | " | " | Dimethyl-polysiloxane (10,000 centistokes) 2 g |
| | | | | (Control) |

Notes:
[1]The figures show the amounts added for 10 g of dried gelatin.
[2]The lubricants were added in the form of an emulsion in gelatin. Each emulsion had a mean particle size of about 0.5 to about 0.8 $\mu$. No coating aid was added since the surfactant used as the emulsifier imparted adequate coating properties.
[3]Since the control containing dodecylbenzenesulfonate alone as an emulsifier was unable to be coated on the film due to repellency, 40 ml of a 2% aqueous solution of the following ampheteric surfactant:

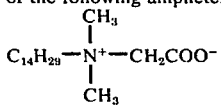

The samples were cut to a width of 8 mm (Single Eight System) and tested for adhesion to camera gates in the following manner:

After the samples, which are adapted for the Single Eight System, were allowed to stand for 2 hours in a room maintained at 35° C and 90% relative humidity, the samples were loaded in cameras. Confirmation that the samples could move was made by operating the shutter. After standing for 5 minutes under the same conditions, the cameras were driven again. If the emulsion surface adhered firmly to the camera gate, the film did not move. The operations were repeated by exchanging cameras so that each sample was tested 3 times in each camera and 24 times in total, and times where the film moved were counted. The results obtained are shown in Table 2.

Table 2

| | Sample | | | | | | | |
|---|---|---|---|---|---|---|---|---|
| | (1a) | (1b) | (1c) | (1d) | (1e) | (1f) | (1g) | (1h) |
| Times | 2 | 22 | 21 | 20 | 20 | 23 | 21 | 11 |

The samples were then processed according to the following steps:

| | Minutes |
|---|---|
| 1. Hardening | 1 |
| 2. Washing | 2 |
| 3. Negative Development | 4 |
| 4. Washing | 3 |
| 5. Reversal Red-Light Exposure | |
| 6. Cyan Color Development | 4 |
| 7. Washing | 3 |
| 8. Reversal Blue-Light Flash Exposure | |
| 9. Yellow Color Development | 4 |
| 10. Washing | 3 |
| 11. Reversal White-Light Exposure | |
| 12. Magenta Color Development | 4 |
| 13. Washing | 3 |

-continued

| | Minutes |
|---|---|
| 14. Silver Bleaching | 3 |
| 15. Fixing | 3 |
| 16. Washing and Drying | 3 |

Each processing was effected at a temperature of 27° C using baths having the following compositions:

| | |
|---|---|
| Hardening Bath | |
| Sodium Hexametaphosphoric Acid | 2.0 g |
| Sodium Bisulfite | 5.0 g |
| Sodium Pyrophosphoric Acid (decahydrate) | 15.0 g |
| Sodium Sulfate | 100.0 g |
| Potassium Bromide | 2.0 g |
| Sodium Hydroxide | 0.1 g |
| Formaldehyde (37%) | 17.0 ml |
| Water to make | 1000 ml |
| Negative Developing Solution | |
| N-methyl-p-aminophenol Sulfate | 5.0 g |
| Sodium Sulfite | 79.0 g |
| Hydroquinone | 2.0 g |
| Sodium Hydroxide | 1.0 g |
| Sodium Carbonate (monohydrate) | 41.0 g |
| Potassium Iodide (0.1%) | 12.5 ml |
| Sodium Bromide | 3.6 g |
| Sodium Hydroquinonemonosulfate | 4.0 g |
| Potassium Thiocyanate | 2.0 g |
| 6-Nitrobenzoimidazole Nitrate (0.5%) | 5.0 ml |
| Water to make | 1000 ml |
| Cyan Color Developing Solution | |
| Potassium Bromide | 2.9 g |
| 6-Nitrobenzoimidazole Nitrate (1%) | 3.0 ml |
| Potassium Iodide (1%) | 11.0 ml |
| Sodium Sulfite | 10.0 g |
| Sodium Sulfate | 60.0 g |
| Potassium Thiocyanate | 1.2 g |
| 4-Amino-3-methyl-N-ethyl-N-($\beta$-hydroxyethyl)aniline Sulfate | 2.5 g |
| Sodium Hydroxide | 3.4 g |
| 1-Hydroxy-N-(2-propionamido-phenethyl)-2-naphthamido-2,4-dichloro-1-naphthol | 0.2 g |
| 2-Methyl-2,4-pentanediol | 10.0 ml |

-continued

| | |
|---|---|
| Polyoxyethylene Methyl Phenyl Ether | 0.5 g |
| Monobenzyl-p-aminophenol Hydrochloride | 0.4 g |
| P-Aminophenol Hydrochloride | 0.12 g |
| Water to make | 1000 ml |
| Yellow Color Developing Solution | |
| Sodium Sulfite | 10.0 g |
| Potassium Bromide | 0.65 g |
| Potassium Iodide (0.1%) | 29.0 ml |
| 6-Nitrobenzoimidazole Nitrate (1%) | 10.0 ml |
| Sodium Sulfate | 64.0 g |
| N,N-Diethyl-p-phenylenediamine Hydrochloride | 3.0 g |
| Sodium Hydrochloride | 2.4 g |
| 2-Methyl-2,4-pentanediol | 20.0 ml |
| 2-Benzoyl-2'-methoxyacetanilide | 1.8 g |
| Diethylhydroxylamine | 0.3 ml |
| Polyoxyethylene Methyl Phenyl Ether | 0.8 g |
| Water to make | 1000 ml |
| Magenta Color Developing Solution | |
| Concentrated Sulfuric Acid | 2.0 ml |
| Potassium Phosphate (dodecahydrate) | 40.0 g |
| Sodium Sulfite | 5.0 g |
| Potassium Thiocyanate | 1.2 g |
| Potassium Iodide (0.1%) | 7.5 ml |
| Potassium Bromide | 0.6 g |
| 4-Amino-3-methyl-N-(β-methylsulfonamideethyl)aniline Sulfate | 2.0 g |
| Ethylene Diamine | 6.0 ml |
| Sodium Hydrochloride | 0.3 g |
| 1-(2,4,6-Trichlorophenyl)-3-(4-nitroanilino)pyrazolone | 1.7 g |
| 2-Methyl-2,4-pentanediol | 100.0 ml |
| Sodium Sulfate | 50.0 g |
| Polyoxyethylene Methyl Phenyl Ether | 0.5 g |
| Water to make | 1000 ml |
| Bleaching Solution | |
| Potassium Ferricyanide | 100.0 g |
| Potassium Bromide | 30.0 g |
| Water to make | 1000 ml |
| Fixing Solution | |
| Sodium Thiosulfate | 125.0 g |
| Sodium Sulfite | 9.0 g |
| Water to make | 1000 ml |

The percentage of the haze in the processed films was determined using a Sphere Method H.T.R. Meter Type SEPH-SS made by Nippon Seimitsu Kikai Co., Ltd. The results obtained are shown in Table 3.

Table 3

| | Sample | | | | | | | |
|---|---|---|---|---|---|---|---|---|
| | (1a) | (1b) | (1c) | (1d) | (1e) | (1f) | (1g) | (1h) |
| Haze(%) | 12.3 | 17.6 | 14.5 | 14.0 | 15.5 | 15.6 | 13.5 | 23.8 |

The values of the sliding degree[5]) of a paper grip to the emulsion surfaces of the films measured by the method described in J. SMPTE, 80, 734–739 (1971) are shown in Table 4.

Table 4

| | Sample | | | | | | | |
|---|---|---|---|---|---|---|---|---|
| | (1a) | (1b) | (1c) | (1d) | (1e) | (1f) | (1g) | (1h) |
| Angle | 19.6° | 10.5° | 9.8° | 10.8° | 11.0° | 10.2° | 9.7° | 15.3° |

As is clearly shown by the results in Table 2, 3 and 4, the organopolysiloxanes in accordance with the present invention are capable of improving the slippage properties and of preventing adhesion difficulties to a remarkably greater extent than the known dimethylpolysiloxane, without increasing the haze markedly. As set forth in Note 3 (Table 1), the organopolysiloxanes in accordance with the present invention are also superior in coating properties to the known dimethylpolysiloxane.

EXAMPLE 2

Onto a cellulose triacetate film support were coated the following layers:

Layer 1:

Anti-halation layer: A gelatin layer containing a brown colloidal silver dispersion and coated at a silver coverage of 3 mg/100 cm².

Layer 2:

Interlayer: A gelatin layer coated at a gelatin coverage of 13.4 mg/100 cm².

Layer 3:

Red-sensitive silver halide emulsion layer: A high-speed gelatino silver iodobromide emulsion layer rendered red-sensitive by a sensitizing dye, containing a cyan coupler (1-hydroxy-4-chloro-N-dodecyl-2-naphthamide dissolved in tricresyl phosphate and dispersed into gelatin), and coated at a silver coverage of 10 mg/100 cm².

Layer 4:

Interlayer: A gelatin layer coated at a gelatin coverage of 3.4 mg/100 cm².

Layer 5:

Green-sensitive silver halide emulsion layer: A high-speed gelatino silver iodobromide emulsion layer which is rendered green-sensitive by a sensitizing dye, containing a magenta coupler (1-[2,6-dichloro-4-methoxyphenyl]-3-{3-[α-(2,4-di-tert-aminophenoxy)-propionamido]benzamido}-5-pyrazolone dissolved in dibutyl phthalate and dispersed into gelatin), and coated at a silver coverage of 15 mg/100 cm².

Layer 6:

Yellow filter layer: A gelatin layer containing a yellow colloidal silver dispersion and coated at a silver coverage of 25 mg/100 cm².

Layer 7:

Blue-sensitive silver halide emulsion layer: A high-speed gelatino silver iodobromide emulsion layer containing a yellow coupler (2-benzoyl-2'-chloro-5'-tridecanoyloxyacetanilide dissolved in dibutyl phthalate and dispersed into gelatin), and coated at a silver coverage of 15 mg/100 cm².

Onto the resulting film were coated as the eighth layer the protective layers having the compositions shown in Table 5 to prepare color light-sensitive materials 2*a* to 2*g*. The protective layers had a thickness of 1.5 μ.

Table 5

| Sample | Matting Agent[6]) | Hardener[6]) | Emulsifier[6),7)] | Lubricant[6),7)] |
|---|---|---|---|---|
| 2a | Silver Halide Grains 5 g + Strontium Barium Sulfate 5 g | Mucochloric Acid (1%) 250 ml | Monooctyl Sodium Sulfosuccinate (1%) 150 ml | Liquid Paraffin 2 g (Control) |
| 2b | " | " | " | Compound (10) 2 g |
| 2c | " | " | " | Compound (12) 2 g |

Table 5-continued

| Sample | Matting Agent[6)] | Hardener[6)] | Emulsifier[6),7)] | Lubricant[6),7)] |
|---|---|---|---|---|
| 2d | " | " | " | Compound (15) 2 g |
| 2e | " | " | " | Compound (16) 2 g |
| 2f | " | " | " | Compound (19) 2 g |
| 2 g | " | " | " | Dimethyl-polysiloxane (5,000 centi-stokes) 2 g (Control) |

Notes:
[6)]The figures show the amounts added for 50 g of dried gelatin.
[7)]The lubricants were added in the form of an emulsion in gelatin. Each emulsion had a mean particle size of about 0.6 to about 1.0 μ. The surfactant used as the emulsifier for the preparation of the gelatin emulsion exibited an effect as a coating aid as well. However, since the coating properties of the control employing dimethylpolysiloxane were not sufficiently improved by the monooctyl sodiumsulfosuccinate alone, 40 ml of a 2% aqueous solution of the following amphoteric surfactant: $C_{14}H_{29}-\overset{\overset{CH_3}{|}}{\underset{\underset{CH_3}{|}}{N^+}}-CH_2COO^-$ The samples were slit into a 16 mm width, loaded in a 16 mm camera (Ekrail NPR), and tested for the production of emulsion dust by driving 400 ft of the sample through the camera. Each sample was tested 10 times. The level of the dust formation was evaluated according to the following ranking: A; No dust; E: A large amount of dust; and C: A small amount of dust. The results obtained are shown in Table 6.

Table 6

| | Sample | | | | | | |
|---|---|---|---|---|---|---|---|
| | (2a) | (2b) | (2c) | (2d) | (2e) | (2f) | (2g) |
| Dust Production Level | E | A | A | A | A | A | C |

The samples were then processed according to the following steps:

| | Minutes |
|---|---|
| 1. Hardening | 1 |
| 2. Washing | 1 |
| 3. First Development | 3 |
| 4. Washing | 0.5 |
| 5. Raversal Exposure | |
| 6. Second Development | 4 |
| 7. Washing | 1 |
| 8. Bleaching | 1 |
| 9. Washing | 0.5 |
| 10. Fixing | 1 |
| 11. Washing | 1 |

Each step was carried out at a temperature of 30° C, using baths having the following compositions:

| | |
|---|---|
| Hardening Bath | |
| Sulfuric Acid (1:1 by volume with water) | 5.4 ml |
| Sodium Sulfate | 150.0 g |
| Sodium Acetate | 20.0 g |
| Pyruvic Acid (30%) | 40.0 ml |
| Formaldehyde (37%) | 20.0 ml |
| Water to make | 1000 ml |
| First Developing Solution | |
| N-methyl-p-aminophenol Sulfate | 2.0 g |
| Sodium Sulfite | 90.0 g |
| Sodium Sulfite | 90.0 g |
| Hydroquinone | 8.0 g |
| Sodium Carbonate (monohydrate) | 52.5 g |
| Potassium Bromide | 5.0 g |
| Potassium Thiocyanate | 1.0 g |
| Water to make | 1000 ml |

-continued

| | |
|---|---|
| Second Developing Solution | |
| Benzyl Alcohol | 5.0 ml |
| Sodium Sulfite | 5.0 g |
| Hydroxylamine Hydrochloride | 2.0 g |
| 3-Methyl-4-amino-N-ethyl-(β-methylsulfonamideethyl)aniline Phosphate Sulfate | 1.5 g |
| Potassium Bromide | 1.0 g |
| Sodium Phosphate | 3.0 g |
| Sodium Hydroxide | 0.5 g |
| Ethylene Diamine (70%) | 7 ml |
| Water to make | 1000 ml |
| Bleaching Solution | |
| Potassium Ferricyanide | 100 g |
| Sodium Acetate | 40 g |
| Glacial Acetic Acid | 20 ml |
| Potassium Bromide | 30 g |
| Water to make | 1000 ml |
| Fixing Solution | |
| Sodium Thiosulfate | 150 g |
| Sodium Acetate | 70 g |
| Sodium Sulfite | 10 g |
| Potassium Alum | 20 g |
| Water to make | 1000 ml |

The percentage of haze in the film thus obtained was determined in the same manner as described in Example 1. The results obtained are shown in Table 7.

Table 7

| | Sample | | | | | | |
|---|---|---|---|---|---|---|---|
| | (2a) | (2b) | (2c) | (2d) | (2e) | (2f) | (2g) |
| Haze(%) | 13.5 | 14.9 | 16.7 | 16.7 | 17.3 | 17.6 | 24.9 |

The values of the sliding degree[8)] of a paper grip to the emulsion surface of the film measured in a similar manner as described in Example 1 are shown in Table 8.

Table 8

| | Sample | | | | | | |
|---|---|---|---|---|---|---|---|
| | (2a) | (2b) | (2c) | (2d) | (2d) | (2f) | (2g) |
| Angle | 17.3° | 8.7° | 8.8° | 9.2° | 9.5° | 9.8° | 13.4° |

The abrasion resistance of the samples were measured using the following testing method:

A sapphire needle having a diameter of 0.1 mm was run 10 cm on the emulsion surface of a film while applying a load which was continuously increased from 0 to 200 g as the 10 cm distance was traversed. The abrasion resistance was given from the load corresponding to the distance from the starting point to the point at which the protective layer was damaged to the surface of the emulsion layer (for example, a distance of 4 cm. corresponds to an abrasion resistance of 80 g a distance of 6 cm corresponds to an abrasion resistance of 120 g, etc.).

The results obtained are shown in Table 9.

Table 9

| | Sample | | | | | | |
|---|---|---|---|---|---|---|---|
| | (2a) | (2b) | (2c) | (2d) | (2e) | (2f) | (2g) |
| Abrasion[9] Resistance (g) | 95 | 141 | 142 | 137 | 135 | 134 | 116 |

Note:
[9]Mean value for ten replications.

As is clearly shown by the above results, the organopolysiloxanes used in the present invention are superior in all respects to the known liquid parrafin, as well as polydimethylsiloxane.

In addition, when applied to negative color motion picture films, the organopolysiloxanes in accordance with the present invention exhibited excellent effects as well.

EXAMPLE 3

A poly(ethylene terephthalate) film support was coated with a high-speed gelatino silver iodobromide (silver iodide content 1.5 mol%) X-ray emulsion sensitized using sulfur and gold sensitization methods and a protective layer having the composition shown in Table 10, to prepare samples 3*a* to 3*c*. The protective layer had a dried thickness of 1.2 $\mu$.

Table 10

| Composition of the Protective Layer | Sample 3a | 3b | 3c |
|---|---|---|---|
| Gelatin | 1,000 g | 1,000 g | 1,000 g |
| Water | 10 l | 10 l | 10 l |
| Silica (Matting Agent) | 15 g | 15 g | 15 g |
| Saponin (Coating aid) | 100 g | 100 g | 100 g |
| Water-Dispersion[10] Containing Compound (10) | — | 25 ml | — |
| Water-Dispersion[10],[11] Containing Dimethylpolysiloxane (Control) | — | — | 25 ml |
| 2% Aqueous Solution of 2,4-Dichloro-6-hydroxy-1,3,5-triazine Sodium Salt (Hardener) | 200 ml | 200 ml | 200 ml |

Notes:
[10]The emulsion was prepared by mixing 35 parts of liquid organopolysiloxane and 1.5 parts of polyoxyethylene dodecyl ether in a homomixer, along with the gradual addition of 63.5 parts of water.
[11]The dimethylpolysiloxane had a viscosity of 10,000 centistokes.

The static friction of the X-ray films thus obtained was determined against the surfaces of the same film, an intensifying paper often commercially used with X-ray films and metal (stainless steel) under the conditions of 25° C and 65% relative humidity, and the results as shown in Table 11 were obtained.

Table 11

| Coefficient[12] of Static Friction | Sample 3a | 3b | 3c |
|---|---|---|---|
| Against Film | 0.57 | 0.42 | 0.51 |
| Against Intensifying Paper | 0.45 | 0.32 | 0.38 |
| Against Stainless Steel | 0.30 | 0.14 | 0.20 |

Note:
[12]Mean value for 5 replications

The samples were then processed in a commercially available automatic processor (Fuji X-ray Processer RN made by the Fuji Photo Film Co., Ltd.) under the conditions of 90 sec. processing, and the haze in the processed films were determined by the same method as described in Example 1. The results obtained are shown in Table 12. No difference was observed in the photographic properties and hardening properties of these samples.

Table 12

| | Sample (3a) | (3b) | (3c) |
|---|---|---|---|
| Haze (%) | 26 | 27 | 31 |

As is clearly shown by the results shown above, in the samples according to this invention, the slippage properties are remarkably improved compared with that of the control samples, and the transparency, photographic properties and hardening properties are equal to those of the control samples.

While the invention has been described in detail and with reference to specific embodiments thereof, it will be apparent to one skilled in the art that various changes and modifications can be made therein without departing from the spirit and scope thereof.

What is claimed is:

1. A photograhic light-sensitive material comprising a support having thereon at least one light-sensitive silver halide emulsion layer and with at least one photographic layer of the photographic light-sensitive material containing a liquid organopolysiloxane having therein at least one siloxane unit in which (1) a methyl group and (2) a member of the group consisting of an alkyl group, a cycloalkyl group, an alkoxyalkyl group, an aralkyl group, an aryloxyalkyl group or a 2,3-epoxypropyloxyalkyl group, each member of said group (2) having at least 5 carbon atoms, are attached to the silicon atom of the siloxane unit.

2. The photographic light-sensitive material according to claim 1, wherein said liquid organopolysiloxane is a cyclic organopolysiloxane having therein a siloxane unit represented by the following general formula (I):

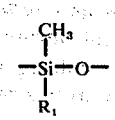

(I)

wherein $R_1$ has from 5 to 20 total carbon atoms and represents an alkyl group, a cycloalkyl group, an alkoxyalkyl group, an aralkyl group, an aryloxyalkyl group or a 2,3-epoxypropyloxyalkyl group.

3. The photographic light-sensitive material according to claim 1, wherein said organopolysiloxane is a straight-chain organopolysloxane having therein a siloxane unit represented by the following formula (I):

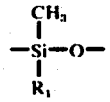

(I)

wherein $R_1$ has from 5 to 20 total carbon atoms and represents an alkyl group, a cycloalkyl group, an alkoxyalkyl group, an aralkyl group, an aryloxyalkyl group or a 2,3-epoxypropyloxyalkyl group; and has terminal groups represented by the following general formula (II):

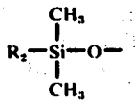

(II)

wherein $R_2$ represents (a) an alkyl group having from 1 to 20 carbon atoms or (b) a cycloalkyl group, an alkoxyalkyl group, an aralkyl group, an aryloxyalkyl group or a 2,3-epoxypropyloxyalkyl group, each having from 5 to 20 carbon atoms.

4. The photographic light-sensitive material according to claim 1, wherein said polyorganosiloxane is a compound having therein siloxane units of the following formulas (III) or (IV):

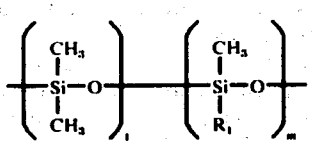

(III)

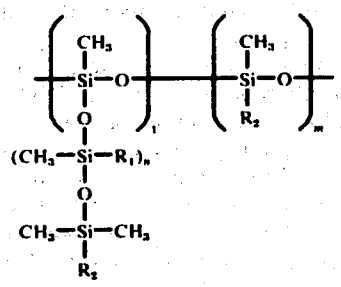

(IV)

wherein $R_1$ has from 5 to 20 total carbon atoms and represents an alkyl group, a cycloalkyl group, an alkoxyalkyl group, an aralkyl group, an aryloxyalkyl group or a 2,3-epoxypropyloxyalkyl group; $R_2$ represents (a) an alkyl group having from 1 to 20 carbon atoms or (b) a cycloalkyl group, an alkoxyalkyl group, aralkyl group, an aryloxyalkyl group or a 2,3-epoxypropyloxyalkyl group, each having from 5 to 20 carbon atoms; l represents 0 or a positive integer; m represents a positive integer; and l+m represents a positive integer of 1 to 1,000; and has terminal groups represented by the general formula (II)

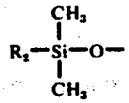

wherein $R_2$ is as described above.

5. The photographic light-sensitive material according to claim 1, wherein said organopolysiloxane is present in an outermost layer of said photographic light-sensitive material.

6. The photographic light-sensitive material according to claim 5, wherein said organopolysiloxane is present in an amount of from about 0.02 to about 10% by weight based on the solid content of said outermost layer.

7. The photographic light-sensitive material of claim 2, wherein $R_1$ is a pentyl group, a methylpentyl group, a cyclopentyl group, a cyclohexyl group, a dimethylpentyl group, a heptyl group, a methylhexyl group, an octyl group, an eicosyl group, a phenyl-ethyl group, a methylphenylethyl group, a phenylpropyl group, a cyclohexylpropyl group, a dibenzyloxypropyl group, a phenoxy-propyl group, tolyloxypropyl group, an ethoxypropyl group, a butoxypropyl group, an octadecyloxypropyl group, a 2,3-epoxypropyloxypropyl group, or a 2,3-epoxypropyloxybutyl group.

8. The photographic light-sensitive material according to claim 3, wherein $R_1$ is a pentyl group, a methylpentyl group, a cyclopentyl group, a cyclohexyl group, a dimethylpentyl group, a heptyl group, a methylhexyl group, an octyl group, an eicosyl group, a phenylethyl group, a methylphenylethyl group, a phenyl-propyl group, a cyclohexylpropyl group, a dibenzyloxypropyl group, a phenoxypropyl group, tolyloxypropyl group, an ethoxypropyl group, a butoxypropyl group, an octadecyloxypropyl group, a 2,3-epoxypropyloxypropyl group, or a 2,3-epoxypropyloxybutyl group and $R_2$ is a methyl group, an ethyl group, a propyl group, an n-butyl group, a sec-butyl group, a tert-butyl group and those groups as defined for $R_1$.

9. The photographic light-sensitive material according to claim 4, wherein $R_1$ is a pentyl group, a methylpentyl group, a cyclopentyl group, a cyclohexyl group, a dimethylpentyl group, a heptyl group, a methylhexyl group, an octyl group, an eicosyl group, a phenylethyl group, a methylphenylethyl group, a phenylpropyl group, a cyclohexylpropyl group, a dibenzyloxypropyl group, a phenoxypropyl group, tolyloxypropyl group, an ethoxypropyl group, a butoxypropyl group, an octadecyloxypropyl group, a 2,3-epoxypropyloxypropyl group, or a 2,3-epoxypropyloxybutyl group and $R_2$ is a methyl group, an alkyl group, a propyl group, an n-butyl group, a sec-butyl group, a tert-butyl group and those groups as defined for $R_1$.

10. The photographic light-sensitive material according to claim 4, wherein l+m represents a positive integer of 2 to 500.

11. The photographic light-sensitive material according to claim 3, wherein said organopolysiloxane comprises 10 to 80 mole % of dimethylsiloxane units of the general formula (II) and 20 to 90 mole % of siloxane units represented by the general formula (I).

12. The photographic light-sensitive material of claim 1, wherein said organopolysiloxane has a refractive index of 25° C of about 1.405 to 1.650.

13. The photographic light-sensitive material of claim 1, wherein said organopolysiloxane has a viscosity at 25° C of about 20 to 100,000 centistokes.

14. The photographic light-sensitive material according to claim 1, wherein the particle size of said organopolysiloxane in said layer ranges from about 0.1 to 10 microns.

* * * * *